United States Patent [19]

Everett et al.

[11] Patent Number: 4,853,294

[45] Date of Patent: Aug. 1, 1989

[54] CARBON FIBER REINFORCED METAL MATRIX COMPOSITES

[75] Inventors: Richard K. Everett, Alexandria; William F. Henshaw, Lorton, both of Va.

[73] Assignee: United States of America as represented by the Secretary of the Navy, Washington, D.C.

[21] Appl. No.: 212,553

[22] Filed: Jun. 28, 1988

[51] Int. Cl.[4] ..... B32B 15/14; C22C 1/09

[52] U.S. Cl. ..... 428/614; 428/634

[58] Field of Search ..... 428/634, 614, 611, 607, 428/367, 381, 384, 378, 389

[56] References Cited

U.S. PATENT DOCUMENTS

| | | | |
|---|---|---|---|
| 3,535,093 | 10/1970 | Sara | 29/182.2 |
| 3,717,443 | 2/1972 | McMurray et al. | 428/381 |
| 4,223,075 | 9/1980 | Harrigan et al. | 420/634 |
| 4,440,571 | 4/1984 | Ishiwaka et al. | 75/229 |
| 4,500,602 | 2/1985 | Patton et al. | 420/367 |
| 4,511,663 | 4/1985 | Taylor | 420/367 |
| 4,547,435 | 10/1985 | Yamatsuta et al. | 428/614 |
| 4,731,298 | 3/1988 | Shindo et al. | 428/611 |
| 4,737,382 | 4/1988 | Katzman et al. | 427/228 |

OTHER PUBLICATIONS

Shindo, "Chemical Property of Carbon Fiber Surface and Interfacial Compatibility of Composites", *Composite Interfaces,* pp. 93–100, H. Ishida and J. L. Koenig editors, Elsevier Science Publishing Co. Inc., (1986).

Honjo et al., "Interfacial Behavior of Aluminum Matrix Composites Reinforced with Ceramics–Coated Carbon Fibers", *Composite Interfaces,* pp. 101–107, H. Ishida and J. L. Koenig editors, Elsevier Science Publishing Co. Inc., (1986).

Lee et al., "Effects of Compounds as Diffusion–Barrier Coatings between the Fiber and the Matrix in Tungsten Fiber Reinforced Nickel Matrix Composites", *Progress in Science and Engineering of Composites,* Hayashi et al., Ed., ICCM–IV, Tokyo, (1982).

Hack et al., *Advanced Fibers and Composites for Elevated Temperatures,* pp. 42 to 54, edited by I. Ahmad, Conference Proceedings, Metallurgical Society of AIME, (1980). Everett et al., "Thin Sheet Titanium Aluminide Metal Matrix Composites", National Aero-Space Plane Program (NASP) Technical Memorandum 1010, Jan. 1988.

*Primary Examiner*—John J. Zimmerman

*Attorney, Agent, or Firm*—Thomas E. McDonnell; A. David Spevack

[57] ABSTRACT

An improved metal, alloy, or intermetallic matrix composite containing carbon reinforcing fibers is formed. The carbon reinforcing fibers are protected from interaction with the matrix material by an inner and an outer barrier layer. The outer layer is any one of the group of stable, non-reactive ceramic materials used to protect fibers, and the inner layer is a ductile, low density, oxygen desorbing rare earth metal. The carbon fibers are particularly useful in forming composites with a titanium aluminide matrix.

15 Claims, 1 Drawing Sheet

CARBON FIBER REINFORCED METAL MATRIX COMPOSITES

BACKGROUND OF THE INVENTION

1. Field of the Invention

This invention relates to improved carbon fiber reinforced metal matrix composites. More particularly, the invention relates to reinforced metal matrix composites having two barrier layers on the carbon reinforcing fiber.

2. Description of the Prior Art

Stiff, strong, and thin metal and metal-like materials are needed for many engineering applications such as "skins" for aircraft, rockets and ground vehicles. Composites, consisting of a matrix of metal, alloy or intermetallic material strengthened by the inclusion of reinforcing fibers of a ceramic, metal, carbon or other material, have been found useful for these applications. Composites are often stronger and lighter than the matrix material forming the composite.

The term metal is used both specifically to refer to products made of the pure metal elements and generically to refer to products made from metal alloys of two or more elements and intermetallic compounds. As is recognized in the art, an alloy is a solid solution where the components can be present in any possible ratio within broad limits. An intermetallic is a compound in which the constituents join together in specific ranges of ratios.

Often problems occur when a reinforcing fiber is added to a matrix. For example, the reinforcing fiber can interact with the matrix during formation of or service in the composite, the fiber can release materials harmful to the matrix, or the fiber may simply dissolve in the matrix. In addition, the resulting reaction zone and the degraded fibers can make the composite brittle if there is too strong a bond between the fiber and matrix. In this application, the term reinforcing fiber is intended to refer to all strengthening inclusions such as ribbons, whiskers, fibers, platelets and the like.

Titanium metal matrix composites containing carbon reinforcing fibers are prone to these and other problems. Titanium aluminide metal matrix composites are particularly prone to these problems. Here, the term titanium metal matrix will be understood to include the pure metal, alloys, and intermetallic compounds of titanium. Barrier layers or coatings on the reinforcing fiber have been suggested as the solution to the problems of adding reinforcing fibers, particularly carbon fibers, to a metal matrix.

Katzman, in U.S. Pat. No. 4,737,382, suggests a carbide coating prepared by depositing an organometallic compound followed by pyrolysis. Ishikawa et al., in U.S. Pat. No. 4,440,571, teaches a surface treatment for inorganic fibers which comprises coating the surface with a titanate, borate, tetralkylammonium hydroxide and dextrin followed by high temperature heat treatment. As early as 1970, Sara, in U.S. Pat. No. 3,535,093, suggested silver coating carbon fibers for use in an aluminum matrix.

Hack et al., in *Advanced Fibers and Composites for Elevated Temperatures,* pp. 42 to 54, edited by I Ahmad, Conference Proceedings, Metallurgical Society of AIME, (1980), suggests Ti/B coatings for $Al_2O_3$ fiber used to reinforce aluminum composites. Shindo in "Chemical Property of Carbon Fiber Surface and Interfacial Compatibility of Composites", *Composite Interfaces,* pp. 93–100, H. Ishida and J. L. Koenig editors, Elsevier Science Publishing CO. Inc., (1986), reports the use of dual layers of carbon and SiC to protect carbon fibers in an aluminum matrix. Shindo suggests using the carbon layer to protect the fiber from the SiC.

With regard to titanium matrix composites, commercially available SCS-6 SiC fibers made by Textron Inc. (formerly Avco) have surface layers coated with modified compositions of carbon and silicon. The purpose of the layers is to increase the fiber's compatibility with titanium alloys. Also, boron carbide coated SiC fibers have been incorporated into titanium alloys.

These suggested coatings or layers and others have not solved all of the problems of incorporating carbon fiber into a metal matrix composite, particularly if the metal is titanium. Generally, as a matrix material, titanium is a more reactive metal than aluminum. Titanium destroys most coatings. Intermetallics of titanium, such as titanium aluminide, have additional problems. When used as matrices, titanium intermetallics produce large stresses in the composite because of thermal expansion mismatch and because of their low ductility which makes them prone to matrix cracking.

SUMMARY OF THE INVENTION

Accordingly, it is an object of this invention to improve carbon fiber reinforced metal matrix composites It is also an object of this invention to improve carbon fiber reinforced titanium metal matrix composites It is an object of this invention to reduce detrimental reactions which occur between the reinforcing fiber and matrix.

Additionally, it is an object of this invention to reduce matrix cracking from thermal expansion mismatch between fiber and matrix.

Also, it is an object of this invention to protect the reinforcing fiber during consolidation of the matrix and in service in the matrix.

Another object of this invention is to improve the fracture toughness of titanium aluminide composites.

Yet another object of this invention is to have an oxygen absorbing barrier layer to protect the metal matrix.

Further, it is an object of this invention to have an inner barrier layer which protects the carbon reinforcing fiber from chemical interaction with the outer barrier layer.

In addition, it is an object of this invention to have an outer barrier layer which protects the inner barrier layer and the reinforcing fiber from chemical interacts on with the matrix.

Yet another object of this invention is to have an inner layer which promotes the adhesion of the outer barrier layer to the carbon fiber.

These and other objects of the invention are accomplished by a metal matrix, preferably titanium, composite containing carbon fibers protected by an inner barrier layer of a low density, ductile, oxygen absorbing rare earth metal and an outer barrier layer of a ceramic material.

BRIEF DESCRIPTION OF THE DRAWINGS

A more complete appreciation of the invention will be readily obtained by reference to the following Detailed Description of the Invention and the accompanying drawings in which like numerals in different figures represent the same structures or elements, wherein.

DETAILED DESCRIPTION OF THE INVENTION

The addition of carbon filters to a metal matrix, particularly a titanium metal matrix, preferably a titanium aluminide matrix, results in a material with better specific properties and fracture toughness than the intermetallic alone. The reinforcing material is added to the composite up to about 60 volume percent. Preferably, carbon reinforcing fiber is incorporated into the matrix to about 30 volume percent.

Figure 1:
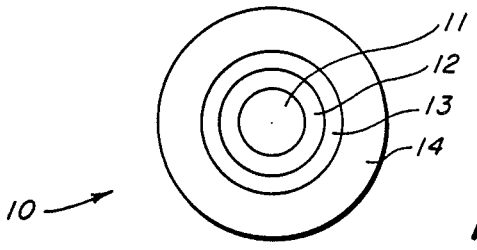
FIG. 1 is a cross section of a fiber in accordance with this invention.

To be included in a metal matrix, particularly a titanium aluminide matrix, a carbon reinforcing fiber must be protected. The fiber is protected by coating it with an inner barrier layer and an outer barrier layer as shown in FIG. 1 wherein the coated fiber, 10, has a carbon fiber core, 11, such as that derived from Celion 12000 produced by Celanese Corp., an inner barrier, 12, formed from a ductile, low density, oxygen absorbing rare earth metal, an outer barrier, 13, formed from materials used as barrier layers in metal matrix materials, particularly titanium metal matrix, and a matrix material, 14, of the kind formed into relatively thin plates or sheets.

The carbon reinforcing fiber is protected from interaction with both the matrix and the outer barrier layer by the inner barrier layer. Gadolinium, yttrium and erbium form good inner barrier layers with gadolinium being most preferred. Also, the inner layer acts as a diffusion barrier providing protection to the matrix by absorbing any oxygen desorbed by the carbon fiber and providing the compliance necessary to maintain a continuous interphase.

The outer barrier layer can be any material which is stable and non-reactive. Based on thermodynamic studies such as reported by MSNW, Inc., "Theoretical and experimental Studies of phase and Constituent Compatibility", L. Yang, J. Norman, G. Reynolds, Sept. 4, 1986.; S. Lyon, S. Inove, C. Alexander and D. Niesz, "The Interaction of Titanium with Refractory Oxides", Titanium Science and Technology, Vol.I, R. I. Jaffee and H. M. Burte, ed., Plenum Press, 1973; R. C. Waugh, "Suitable Oxides for Dispersion Strengthening of Titanium Alloys," International Journal of Powder Metallurgy and Powder Technology, (2), pp. 85–89, (1976), rare-earth oxides, titanium compounds and certain sulfides are promising barriers. Materials such as $Gd_2O_3$, $Y_2O_3$, $Er_2O_3$, $HfO_2$, TiN and TiC are preferred.

Other candidate materials, while not completely stable, still exhibit reaction rates slow enough to allow them to be considered as outer barrier materials. The results of earlier experiments indicate that alumina($Al_2O_3$) has no observable signs of reaction in contact with TiAl at high temperatures. This permits alumina to be used as a preferred outer barrier coating material.

Both layers can be coated on the carbon reinforcing fibers by several processes known for coating barrier layers on fiber. Physical vapor deposition (PVD), described by S. C. Sanday et al., "Fiber Reinforced Metals by Ion-Plating," Naval Research Laboratory Memorandum Report #5686, Apr. 11, 1986, is the preferred method of this invention because the ultra-thin PVD precursor tapes (the form of the coated fiber) can be more easily formed into the desired thin sheets. In addition, PVD can be modified to deposit a variety of suitable inner or outer barriers. Also, other techniques such as conventional casting, chemical vapor deposition (CVD) or liquid-metal infiltration can be used.

It is preferred that the inner barrier be between 0.1 and 2.0 μm thick so that it can operate as a diffusion barrier. It is preferred that the outer barrier be between 0.1 and 2.0 μm thick so that it can serve as a reaction barrier layer.

Once coated, the fiber can be consolidated into the matrix by several different techniques. It is preferred to coat the matrix material over the coated fiber, such as is illustrated in FIG. 1, to layup layers of the coated fiber and to consolidate this combination. This procedure insures a uniform distribution of the fiber in the matrix.

High quality PVD precursor tapes require the uniform coating of the matrix metal onto each individual filament of a well spread fiber tape. When the fibers are not well spread, the PVD process produces metal coatings primarily on the periphery of clusters several fiber layers thick. The absence of coating on the interior fibers results in a non-uniform matrix metal distribution in the consolidated end product.

A fiber spreading technique described in detail by C. Kim and R. Gray, in U.S. patent application Ser. No. 131,684 filed Dec. 11, 1987, and in the article, "Development of Fiber Spreading Technique for Metal Matrix Composites," Naval Research Laboratory Memorandum Report #5831, Dec. 30, 1986, illustrates a method of spreading continuous graphite or other fine filaments from a tow bundle to form a thin, unidirectional filament tape with controlled fiber spacings and minimal fiber damage.

Figure 2:
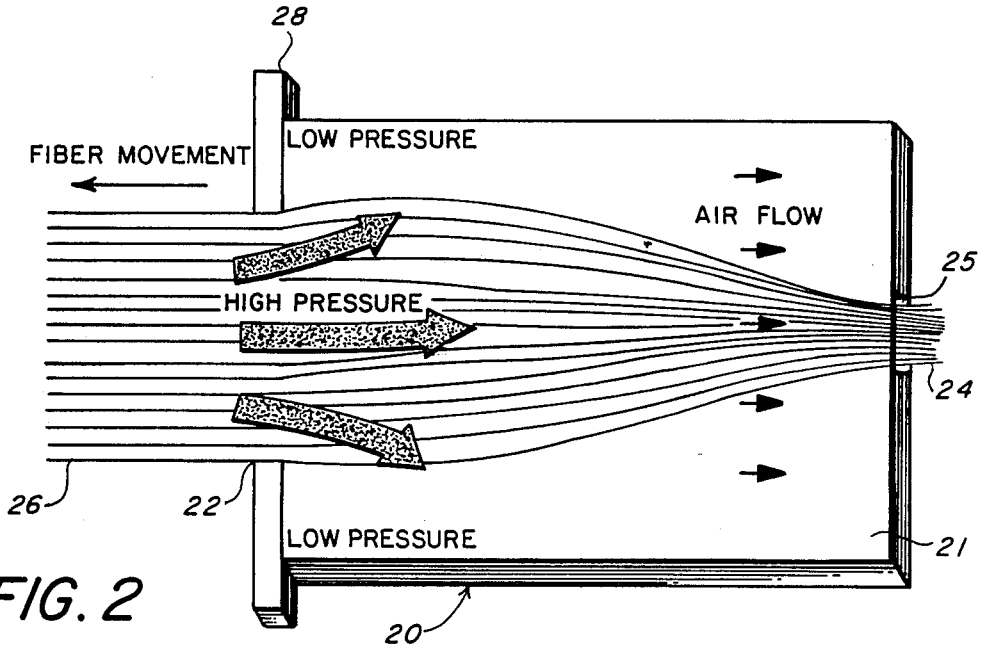
FIG. 2 is a schematic of a fiber spreading machine.

The governing principle of this fiber spreading technique is that of the venturi effect in pneumatic processes. FIG. 2 is a schematic diagram of the fiber spreader, 20, in which a fiber tow, 25, containing individual fibers, 26, moves through an opening, 24, through a low pressure chamber, 21, to a venturi slot, 22. As the fiber tow, 25, passes out of a venturi slot, 22, air is inducted in the opposite direction. This causes the fibers, 26, to spread laterally because a pressure gradient is induced by restrictors, 28, placed on either side of the slot, 22. The heavy arrows in FIG. 2 indicate the general direction of air flow. The spread fibers, 26, are pulled by and wound on a fiber take-up spool, which is not illustrated, and interleaved with aluminum foil.

Figure 3:
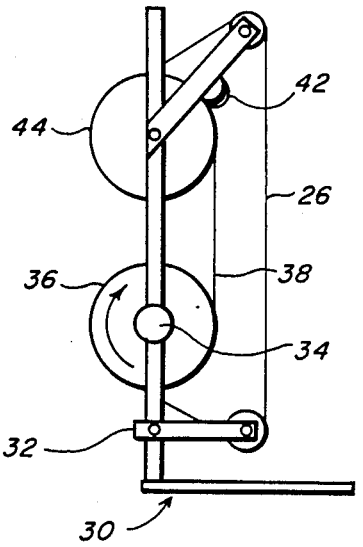
FIG. 3 is a schematic of a fiber coating machine.

A second machine, 30, illustrated in schematic in FIG. 3, transports the spread fibers 26, from the supply spool, 44, past the magnetron vapor sources, (not shown), used for PVD and respools the coated fibers at the take-up spool, 36, with an interleaved aluminum foil layer, 38. The rake-up spool, 36, is driven by motorized gear, 34, and tension in the fiber is controlled by tension bar, 32. The spooling unit, which allows for the application of an ion-plating voltage to the spread fiber by contact, 42, and for variable speeds to control coating thickness, is installed in a vacuum plating chamber. Lengths of tape up to about 8 m (25 ft.) can be loaded onto the spool for plating.

Now having generally described this invention, the following examples illustrate specific application of the invention.

EXAMPLE

An inner barrier layer of gadolinium (Gd) is deposited on spread tows of Celion 12,000 carbon fiber 12,000 filaments per tow, 7 μm average fiber diameter) by pressure-plating using a magnetron vapor source. Films 0.5 μm thick are deposited on the fibers in a chamber which has been evacuated to below $5\times10^{-6}$ Torr and backfilled to $5\times10^{-3}$ Torr with research grade argon. The fibers are held in a frame which is rotated during deposition to provide uniform coverage.

An outer barrier layer of alumina ($Al_2O_3$) is deposited on the inner barrier layer by a modified PVD process such as described by Gilmore et al. "Stabilized Zirconia-Alumina Thin Films," J. Vac. Sci. Technol., A4(6),pp. 2598–2600, (Nov/Dec 1986). The outer film is coated to approximately the same thickness as the inner coating.

Barrier coated fibers are then plated with a titanium and aluminum matrix layer by PVD to form precursor tapes. Titanium aluminide composite sheets are made by stacking the ultra-thin PVD precursor tapes to form unidirectional layups. The number of layers depends upon the amount of precursor available and the desired size of the final plate. Average layups are fifteen plies thick. Face sheets of 0.008 mm (0.003 in.) commercially pure titanium foil are placed on both sides of the layup.

Hot isostatic pressing (HIP) is used for consolidating the layups. Hipping (HIPping) can provide the high temperatures and pressures necessary to consolidate TiAl with good control over the processing variables.

In Hipping the layups are wrapped with 0.03 mm (0.001 in.) tantalum foil which has been sprayed with a boron nitride parting compound. The foil-wrapped layups are placed into a stainless steel pouch and the pouch inserted into a stainless steel vacuum retort. Samples are hot degassed above 300° C. under a dynamic, mechanical pump vacuum to drive off water vapor and other adsorbates. Then the samples are sealed by welding. Samples are hipped at 1200° C. for one hour at an applied pressure of 210 MPa (30 ksi).

Gadolinium/alumina barrier-coated carbon fiber reinforced titanium-aluminum alloy thin sheet composites have been fabricated by the process outlined above. Samples were approximately 25 mm wide by 50 mm long by 0.28 mm thick ($1\times2\times0.011$ in.).

Obviously, many modifications and variations of the present invention are possible in light of the above teachings. It is therefore to be understood that within the scope of the appended claims, the invention may be practiced otherwise than as specifically described.

What we claim is:

1. A composite comprising:

a matrix material selected from the group consisting of pure metal, and metal alloys, and an inner barrier layer of a ductile, low density, oxygen absorbing rare earth metal covering the surface of said fiber, and an outer barrier layer of stable non-matrix-reactive material contiguous with and covering said inner barrier layer.

2. The composite of claim 1 wherein the matrix material is a an intermetallic compound containing titanium.

3. The composite of claim 2 wherein the matrix material is titanium aluminide.

4. The composite of claim wherein the rare earth metal i selected from the group consisting of gadolinium, yttrium and erbium.

5. The composite of claim 2 wherein the rare earth metal is selected from the group consisting of gadolinium, yttrium and erbium.

6. The composite of claim 3 wherein the rare earth metal is selected from the group consisting of gadolinium yttrium and erbium.

7. The composite of claim 4 wherein the rare earth metal is gadolinium.

8. The composite of claim 5 wherein the rare earth metal is gadolinium.

9. The composite of claim 6 wherein the rare earth metal is gadolinium.

10. The composite of claim 2 wherein the outer barrier layer is Alumina.

11. The composite of claim 3 wherein the outer barrier layer is Alumina.

12. The composite of claim 5 wherein the outer barrier layer is Alumina.

13. The composite of claim 6 wherein the outer barrier layer is Alumina.

14. The composite of claim 8 wherein the outer barrier layer is Alumina.

15. The composite of claim 9 wherein the outer barrier layer is Alumina.

* * * * *